United States Patent [19]

Balaban

[11] 4,339,131

[45] Jul. 13, 1982

[54] RACKET STRINGING DEVICE

[76] Inventor: John A. Balaban, 4142 Graham St., Pleasanton, Calif. 94566

[21] Appl. No.: 214,578

[22] Filed: Dec. 8, 1980

[51] Int. Cl.[3] ..... A63B 51/14

[52] U.S. Cl. ..... 273/73 A

[58] Field of Search ..... 273/73 A

[56] References Cited

U.S. PATENT DOCUMENTS

| | | | |
|---|---|---|---|
| 1,943,400 | 1/1934 | Tauber et al. | 273/73 A |
| 2,268,276 | 12/1941 | Caro et al. | 273/73 A X |
| 4,082,272 | 4/1978 | Garver | 273/73 A |
| 4,270,752 | 6/1981 | Strelow | 273/73 A |

FOREIGN PATENT DOCUMENTS

| | | | |
|---|---|---|---|
| 121501 | 6/1946 | Australia | 273/73 A |
| 146018 | 6/1936 | Austria | 273/73 A |
| 213290 | 2/1961 | Austria | 273/73 A |
| 429526 | 5/1935 | United Kingdom | 273/73 A |
| 432813 | 8/1935 | United Kingdom | 273/73 A |
| 488865 | 7/1938 | United Kingdom | 273/73 A |
| 1118777 | 7/1968 | United Kingdom | 273/73 A |

OTHER PUBLICATIONS

Page from Tennis Industries Magazine entitled The Unstrung Hero! by Holland Products, p. 38, Mar./79.

Publication from Mosler Mfg. Co., entitled Operating Description.

Advertising Brochure by Sports Pal Co. Inc., entitled Operating Instructions for Sports Pal "String-Easy" Main String Reverser, P/N 536.

*Primary Examiner*—Richard J. Apley

*Attorney, Agent, or Firm*—Manfred M. Warren; Robert B. Chickering; Glen R. Grunewald

[57] ABSTRACT

A device for aiding in the placement of cross strings in a racket head and having a plurality of transversely spaced substantially coplanar string-bearing surfaces adapted for mounting on a first set of alternate longitudinal strings in the racket head and a plurality of pin-like members mounted for rotation on the support about parallel transversely spaced axes substantially perpendicular to the string bearing surfaces thereon and being mounted for axial displacement. Each of the pin-like members has an offset end rotatable to positions parallel and perpendicular to the longitudinal strings and being positioned for engagement with a second set of longitudinal strings intermediate the first-mentioned strings. Means is provided for jointly rotating the members so as to position them for displacement of the longitudinal strings engaged thereby; and means is provided for jointly axially displacing the members to effect relative displacement of the two sets of alternate longitudinal strings thus opening up a clear lateral path between alternate longitudinal strings for receipt and tensioning of a cross string.

8 Claims, 7 Drawing Figures

RACKET STRINGING DEVICE

BACKGROUND OF THE INVENTION

The invention relates to racket stringing apparatus or machines used for emplacement and tensioning of strings in racket heads, e.g., tennis rackets and the like, and more particularly to devices for aiding in the installation and tensioning of the racket head cross strings.

Racket heads are customarily strung with main strings running longitudinally of the racket parallel to the handle and perpendicularly related cross strings which are woven through the longitudinal strings. In the preferred stringing of a racket, the main or longitudinal strings are first installed and tensioned. Since this is done in the absence of the cross strings, the main strings will be automatically drawn without interference into straight lines across the racket head. The cross strings are then installed by weaving each cross string over and under alternate main strings, the cross string being thus drawn in a sinuous path. As the cross string is tensioned it is pulled into a straighter line and at the same time deflects the main string from its straight line into a sinuous form. The interaction of the main and cross strings upon pulling through and tensioning of the latter has several dilatorious effects. The frictional rubbing of the strings against each other may cause "burning" and consequent weakening of the strings. Secondly and very importantly, it has been found that in the conventional placement and tensioning of the strings as above described it is virtually impossible to obtain a uniformity of tensioning of the cross strings.

Various devices have been proposed to facilitate the placing of the cross strings by engaging and displacing in opposite directions, perpendicularly to the plane of the racket head, alternate main strings so as to open a clear lateral path across the racket head for threading into position and tensioning a cross string. Examples are devices made or distributed by Mosler Mfg. Co. of Los Angeles, Calif.; Holland Products of Lancaster, Pa.; and Sports Pal Co. Inc. of St. Louis, Mo.

Devices heretofore available for assisting in the placing and tensioning of the cross strings in a racket head have not found wide acceptance. They have been awkward and slow to use. Consequently, conventional racket stringing is done in the main without the benefit of a cross-stringing aid.

SUMMARY OF THE INVENTION

The device of the present invention has been designed for convenient, easy and rapid use in offsetting the main strings of the racket to produce a clear lateral path therebetween through which the cross string may be quickly and simply fed and tensioned, resulting in a substantial overall savings in time required to string a racket.

Another object of the present invention is to provide a device of the character described which will protect the strings from being "burned" due to the rubbing friction therebetween during the placement and tensioning of the strings in the conventional racket-stringing process.

A further object of the present invention is to provide a racket-stringing device of the character above which will enable the attainment of much greater accuracy and uniformity in the final "settled in" tension of the cross strings of the racket.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF THE INVENTION

In the stringing of a racket, as for example, a tennis racket, the main or longitudinal strings, running parallel to the handle, are installed and tensioned prior to the placement of the cross strings. Typically, tennis rackets will have 18 longitudinal strings. Since there is no interferring presence of the cross strings at the time of tensioning of the main strings, the latter may be tensioned with good uniformity. The cross strings are then placed, or more specifically woven, through the longitudinal strings, that is, over and under alternate strings in a weaving pattern, and the pattern is reversed on alternate cross strings. The conventional practice is to weave each cross string into place and then to tension it. High frictional rubbing forces between the cross string and the main strings occur in the pulling through and tensioning of the cross string. "Burning" and weakening of the strings may occur in this operation. Also, since the frictional forces are different in the case of each cross string, uniformity of tensioning of the cross strings is difficult if not impossible to obtain.

Figure 6:
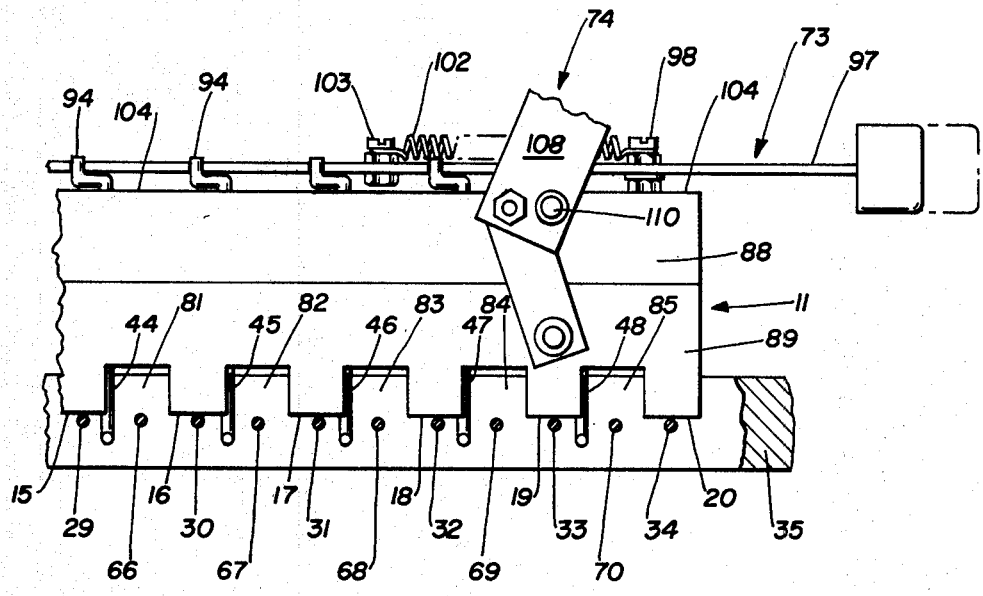
FIG. 6 is a fragmentary side elevation of the device on an enlarged scale and shown operatively in place on a racket head.
Figure 7:
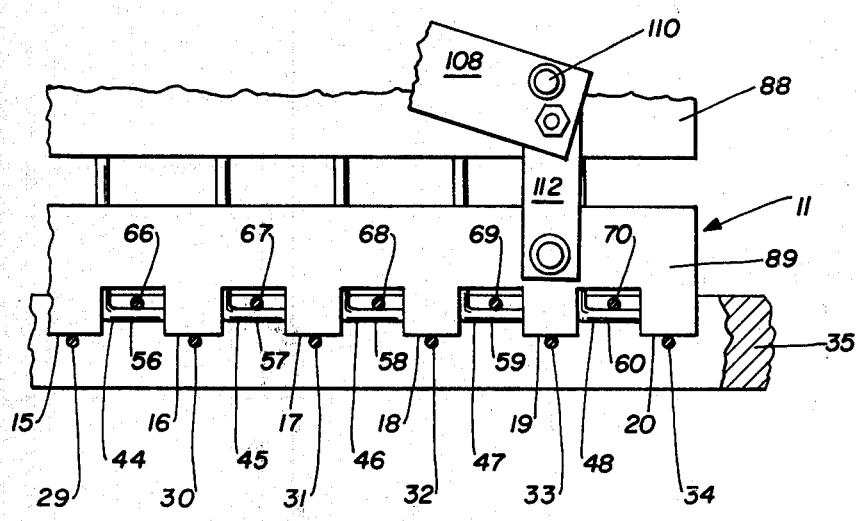
FIG. 7 is a side elevation of the device similar to FIG. 6 but showing the parts in a different position.

The device of the present invention is especially designed for aiding in the placement of the cross strings and comprises briefly a support 11 having a plurality of transversely spaced, substantially coplanar string bearing surfaces 12, 13, 14, 15, 16, 17, 18, 19 and 20 adapted for mounting on a first set of alternate main or longitudinal strings, see strings 29, 30, 31, 32, 33 and 34 in racket head 35 in FIGS. 6 and 7; a plurality of members 41, 42, 43, 44, 45, 46, 47 and 48 mounted for rotation on support 11 about parallel transversely spaced axes substantially perpendicular to surfaces 12–20 and being mounted for axial displacement, each of the members having an offset end 53, 54, 55, 56, 57, 58, 59 and 60 rotatable with the member to first and second positions parallel and perpendicular to longitudinal strings 29–34, respectively, the ends 53–60 in their second perpendicular position being juxtaposed to a second set of longitudinal strings, see strings 66, 67, 68, 69 and 70 in FIGS. 6 and 7, intermediate longitudinal strings 29–34; means 73 for jointly rotating members 41–48 to first and second positions; and means 74 for jointly axially displacing members 41–48 while in their second position to effect relative displacement of the first and second sets of longitudinal strings to provide a clear lateral path therebetween for receipt and tensioning of a cross string, compare position of strings in FIGS. 6 and 7.

Figure 1:
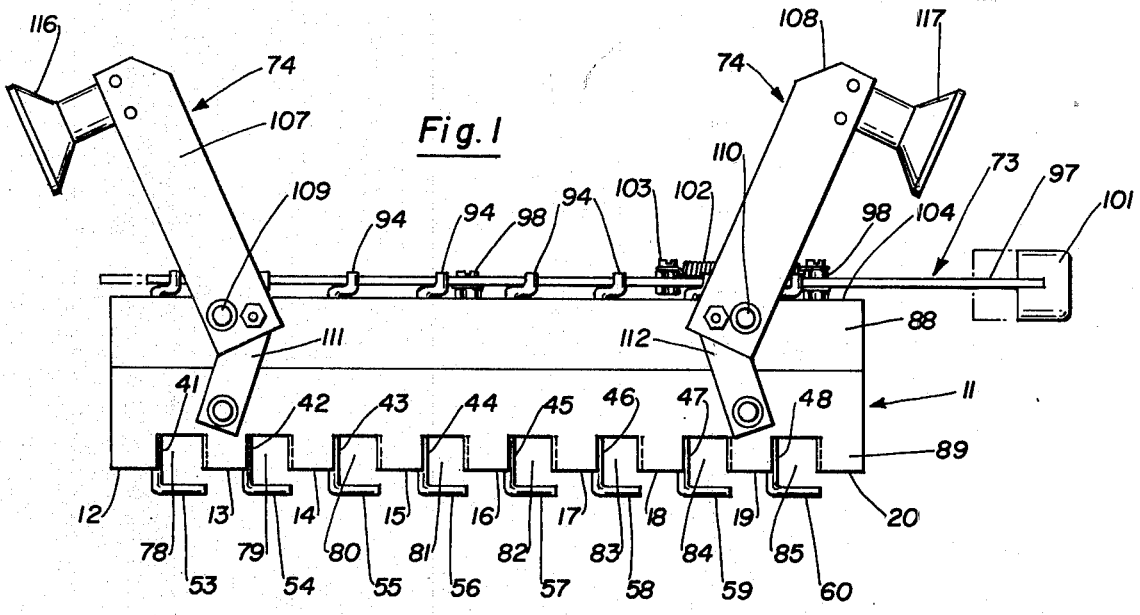
FIG. 1 is a side elevation of a racket-stringing device constructed in accordance with the present invention.
Figure 2:
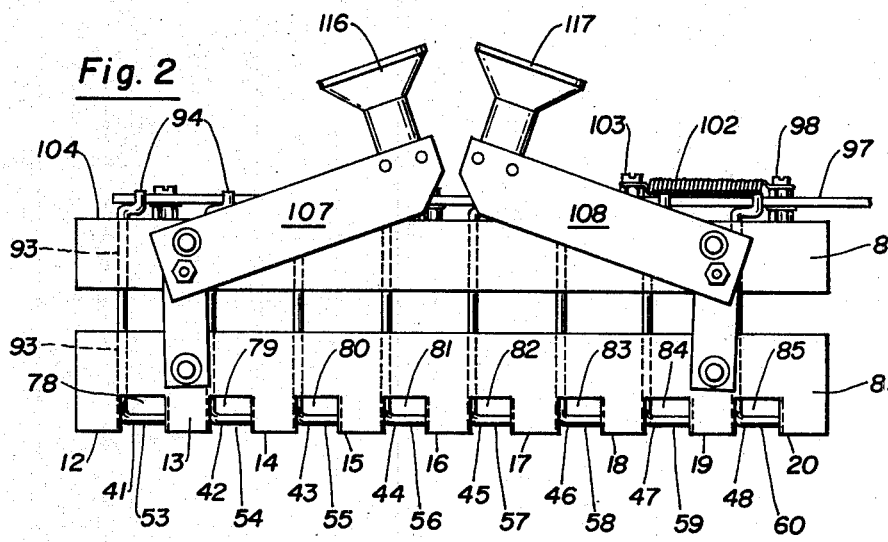
FIG. 2 is a side elevation of the device similar to FIG. 1 but showing the parts in another position.
Figure 3:
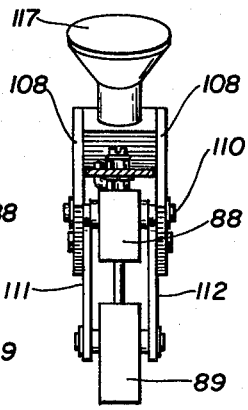
FIG. 3 is an end elevation of the device.

Support 11 is here formed with a plurality of recesses 78, 79, 80, 81, 82, 83, 84 and 85, one between each pair of bearing surfaces 12–20 and dimensioned to receive one of the offset member ends 53–60. The latter when in their position as seen in FIG. 1, are parallel to bearing surfaces 12–20 and perpendicular to main strings 63–70, as seen in FIG. 7, and are dimensioned for movement into the recesses. Axial displacement of the members above-noted will affect a movement of ends 53–60 to a first terminus outside of the recesses, spaced to the exterior of surfaces 12–20, as seen in FIG. 1, to a second terminus inside recesses 78–85 and to the interior of surfaces 12–20, as seen in FIG. 2, whereby ends 53–60 in their first terminus are positioned for engagement with strings 66–70 and on movement to their second terminus will pick up and carry strings 66–70 into the recesses, see FIG. 7, thus producing the desired lateral offset of the two sets of alternate longitudinal strings as seen in FIG. 7. It is important to note that the members 41–48, in their extended position as seen in FIG. 1, may be rotated so as to dispose ends 53–60 parallel to the longitudinal strings, see FIG. 6. Accordingly, in such position the device may be easily and readily applied to the strings by locating surfaces 12–20 on alternate longitudinal strings 29–34 while ends 53–60 will, in their parallel position, pass between the alternate longitudinal strings. Members 41–48 will then be rotated to place ends 53–60 perpendicular to the longitudinal strings and thus in proper juxtaposed relation to the alternate set of longitudinal strings 66–70.

Figure 4:
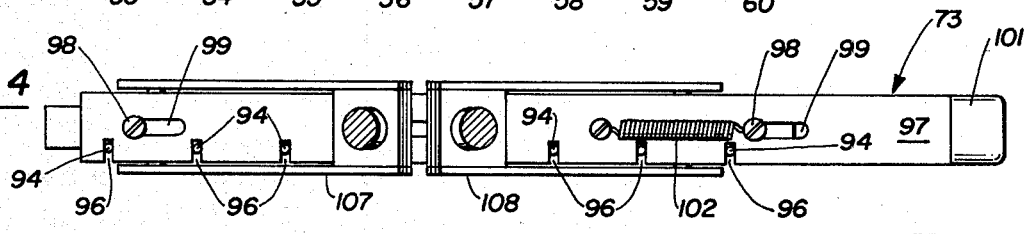
FIG. 4 is a top plan view of the device.
Figure 5:
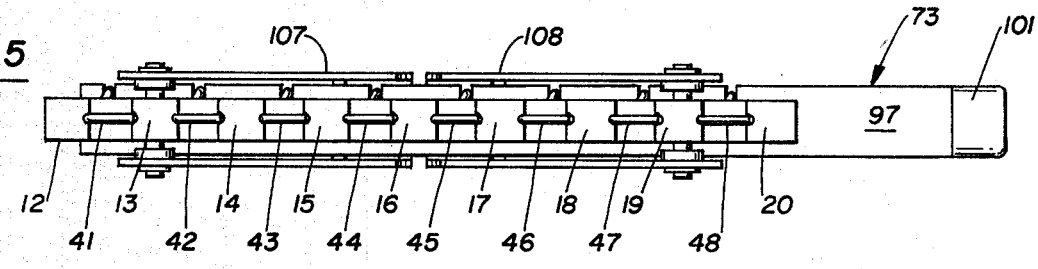
FIG. 5 is a bottom plan view of the device.

Axial displacement of members 41–48 is here effected by subdividing the support 11 into a pair of normally upper and lower elongated sections 88 and 89 and journaling members 41–48 in the upper section 88 while permitting the lower section 89, which here provide the bearing surfaces 12–20 and recesses 78–85, to reciprocate longitudinally on members 41–48 toward and away from section 88 to effect relative displacement of the offset ends 53–60 and recesses 78–85. As here shown, members 41–48 are each composed of an elongated spindle or wire having a straight central portion slidably mounted for rotative and longitudinal displacement within aligned bores 93 in the sections. The normally upper ends 94 of each of the members are offset in crank arms which are engaged in bearing slots 96 in a manually engageable part 97 which is mounted for reciprocation on the upper section 88. Part 97 here comprises a slide retained by fasteners 98 mounted in elongated openings 99 in the slide in superimposed relation on the top of section 88 and over the upper crank ends 94 of the members with such crank ends confined in the bearing slots 96. Accordingly, reciprocation of slide 97 will be accompanied by a rotative displacement of the members, the limit of the rotative drive thus established being determined by the length of openings 99. In the present structure the extension of the slide to the far right-hand position as seen in FIG. 4 will position member ends 53–60 perpendicular to the longitudinal main strings; and displacement of the slide to the left as depicted in phantom in FIG. 1 will cause a rotary displacement of ends 53–60 into parallelism with the main strings. A handle 101 is mounted on one end of slide 97 for convenient manual engagement. A spring 102 is here connected between one of the hold-down fasteners 98 and a pin 103 on the slide so as to constantly bias the slide to the position of ends 53–60 perpendicular to the racket main strings as seen in FIG. 1 and corresponding to the outermost position of handle 101. It will be noted that the location of slide 97 in overlying relation to the crank arms 94 confines the crank arms to the space between slide 97 and the upper surface 104 of section 88 and thus confines members 41–48 and section 88 against relative displacement longitudinally of members 41–48.

Preferably and as hereinabove noted, a simultaneous and conjoint displacement is effected between member ends 53–60 and surfaces 12–20 and recesses 78–85 so that all of the second set of longitudinal strings 66–70 will be simultaneously engaged and displaced into offsetting relation with the set of longitudinal strings 26–34. This is here accomplished by linkage between the sections which maintains them in parallel relation during their displacement toward and away from each other. As here shown, such linkage comprises a pair of manually engageable levers 107 and 108 which have pivotal connections 109 and 110 to section 88, and links 111 and 112 connecting levers 107 and 108 to section 89 whereby joint manual oscillation of the levers will be accompanied by parallel relative displacement between the sections. As will be observed by comparing FIGS. 1 and 2, levers 107 and 108 may be swung from their spaced apart position extending upwardly and away from each other as seen in FIG. 1 to a centrally and downwardly related position as seen in FIG. 2. The position of the levers in FIG. 1 will cause the two sections 88 and 89 to be drawn together thus projecting the lower offset ends 53–60 in their downwardly spaced relation from surfaces 12–20, as seen in FIG. 1. In this position of the levers, slide 97 may be displaced to the left as seen in FIG. 1 thus rotating all of the pin ends 53–60 parallel to the main strings of the racket. The device then may be conveniently and quickly placed onto the main strings with bearing surfaces 12–20 resting upon main strings 26–34 and with the offset ends 53–60 of the members extending between the main strings. Manual engagement of levers 107 and 108 is here facilitated by the provision of knobs 116 and 117, and as will be observed from FIG. 1, knob 117 on lever 108 is positioned quite close to handle 101 on slide 97 so that the two may be simultaneously engaged by one hand of the operator. Thus, with the levers swung apart as seen in FIG. 1, slide 97 may be most conveniently displaced to the left so as to position the parts for mounting on the main strings of the racket. On release of handle 101, slide 97 will be displaced to the right, as seen in FIGS. 1 and 2, by spring 102 thus rotating member ends 53–60 crosswise to and underlying main strings 63–70. The operator will then swing the two levers 107 and 108 towards each other to the position illustrated in FIG. 2, thus displacing main strings 66–70 into recesses 78–85 and effecting the desired offsetting of the alternate main strings for providing a clear lateral path between alternate main strings for receipt and tensioning of a cross string. After emplacement of a cross string, the device is operated in reverse to swing levers 107 and 108 apart to the position illustrated in FIG. 1 to return the main strings to coplanar position, whereupon slide 97 may be displaced to the left against the resistance of spring 102 to swing offset ends 53–60 into parallel position with respect to the main strings, following which the device may be withdrawn. The device as here shown is preferably constructed to engage 17 out of the normal 18 main strings, so that it will only need be shifted laterally on the main strings by one string and repositioned and operated as abovedescribed to open a clear lateral path between the alternate main strings so that the placement of the cross strings proceeds in the conventional weaving pattern.

One of the important features of the present device is that it is operable entirely from the top side of the racket head when the latter is supported in its customary horizontal plane in a racket-stringing machine. In certain of the improved racket stringing machines it is impractical to surround the racket head with a fixture as was required in certain prior cross-stringing devices. Moreover, it will be observed that all of the operating controls of the present device are conveniently positioned at the top of the device when positioned for use in a natural two-handed operation which makes the placement, operation and release of the device very rapid, thus improving the speed with which the racket can be strung. It is estimated that the present device saves about 20 to 25 percent of the time customarily required for the cross-stringing operation.

What is claimed is:

1. A device for aiding in the placement of cross strings in a racket previously strung with substantially coplanar longitudinal strings comprising:

a support having a plurality of substantially coplanar string bearing surfaces transversely spaced for placement on a first set of alternate longitudinal strings in said racket;

a plurality of members mounted for rotation on said support about parallel spaced axes substantially perpendicular to said bearing surfaces and also being mounted for axial displacement relative to said bearing surfaces, each of said members having an offset end rotatable with said members to first and second positions parallel and perpendicular to said longitudinal strings respectively;

said ends in second position being juxtaposed to a second set of longitudinal strings intermediate said bearing surfaces and said first set of alternate longitudinal strings;

means for jointly rotating said members to said first and second positions; and means for jointly axially displacing said members while in said second position to effect relative displacement of said first and second sets of longitudinal strings to provide a clear lateral path therebetween for receipt and tensioning of a cross string.

2. The device of claim 1, said support being formed with a plurality of recesses, one between each adjacent pair of said bearing surfaces and dimensioned to receive one of said member ends; and said ends in second position being aligned with and being dimensioned for movement into said recesses, said axial displacement of said members effecting movement of said ends to and between a first terminus outside said recesses spaced to the exterior of said surfaces and a second terminus inside said recesses to the interior of said surfaces, whereby said ends in first terminus are positioned for engagement with said second set of longitudinal strings and on movement to second terminus will displace said second set of longitudinal strings into said recesses.

3. The device of claim 2, said second-named means comprising a first support section supporting and journaling said members and a second support section providing said bearing surfaces and recesses and being mounted for longitudinal displacement on said members toward and away from said first section to effect relative displacement of said ends and recesses; and said first-named means comprising a manually engageable part movably carried by said first section and having a rotative drive connection to said members.

4. The device of claim 3, said second-named means comprising linkage between said sections maintaining parallel relative displacement thereof toward and away from each other thereby effecting simultaneous relative displacement of said ends and recesses.

5. The device of claim 4, said linkage comprising:

a pair of manually engageable levers pivoted to said first section; and links connecting said levers and second section whereby joint manual oscillation of said levers will be accompanied by said movement of said sections toward and away from each other.

6. The device of claim 3, said rotative drive connection comprising crank arms on said members; and said part having bearings engaging said crank arms and being mounted for reciprocation between first and second terminal positions effecting displacement of said ends to their first and second positions respectively.

7. The device of claim 6, and a spring biasing said part to its first terminal position, said part being manually displaceable against the resistance of said spring to its second terminal position.

8. The device of claim 5, and a spring biasing said part to a first terminal position corresponding with a displacement of said ends to their first position, said part being manually displaceable against the resistance of said spring to a second terminal position corresponding with said second position of said ends; and one of said levers in its position corresponding with the positioning of said sections towards each other being disposed for conjoint one handed engagement with said part.

* * * * *